US006054958A

United States Patent [19]

Holshouser et al.

[11] Patent Number: 6,054,958

[45] Date of Patent: Apr. 25, 2000

[54] QUARTER-WAVE QUARTER-WAVE RETRACTABLE ANTENNA

[75] Inventors: Howard E. Holshouser, Efland; Seung Kil Kim, Chapel Hill, both of N.C.

[73] Assignee: Ericsson Inc., Research Triangle Park, N.C.

[21] Appl. No.: 08/926,656

[22] Filed: Sep. 10, 1997

[51] Int. Cl.[7] ..... H01Q 1/24

[52] U.S. Cl. ..... 343/702; 343/895

[58] Field of Search ..... 343/702, 895, 343/901; H01Q 1/24

[56] References Cited

U.S. PATENT DOCUMENTS

| | | | |
|---|---|---|---|
| 5,374,937 | 12/1994 | Tsunekawa et al. | 343/702 |
| 5,583,519 | 12/1996 | Koike | 343/702 |
| 5,661,496 | 8/1997 | Baek et al. | 343/895 |
| 5,794,158 | 8/1998 | Itoh | 343/702 |

FOREIGN PATENT DOCUMENTS

| | | |
|---|---|---|
| 0613206A1 | 8/1994 | European Pat. Off. . |
| 0734092A1 | 9/1996 | European Pat. Off. . |
| 0772255A1 | 5/1997 | European Pat. Off. . |
| 2308502 | 6/1997 | United Kingdom . |

OTHER PUBLICATIONS

PCT International Search Report, PCT/US98/18819, Oct. 9, 1998.

Silver, S., *Microwave Antenna Theory and Design*, XP002087906, pp. 217–219 (1984).

*Primary Examiner*—Michael C. Wimer

*Attorney, Agent, or Firm*—Myers Bigel Sibley & Sajovec, P.A.

[57] ABSTRACT

Retractable antennas with quarter wave-quarter wave resonances for telephones, and which are particularly suitable for radiotelephones, include a retractable antenna with a top load element, a spatially separated rod element, and a cylindrical support conductor positioned therebetween. The cylindrical support conductor is structurally configured to receive a portion of the rod therein to add structural rigidity to the antenna and to define a coaxial capacitor between the rod and the conductor when the antenna is in the extended position.

15 Claims, 7 Drawing Sheets

QUARTER-WAVE QUARTER-WAVE RETRACTABLE ANTENNA

FIELD OF THE INVENTION

The present invention relates to telephones, and more particularly relates to radiotelephones with retractable antennas.

BACKGROUND OF THE INVENTION

Many radiotelephones employ retractable antennas, i.e., antennas which are extendable and retractable out of the radiotelephone housing. The retractable antennas are electrically connected to a signal processing circuit positioned on an internally disposed printed circuit board. In certain markets, it is desired that the antenna behave as a quarter wave resonator in both the extended and retracted position. Thus, in order to optimally operate, the antenna should be configured to provide the desired impedance to the signal processing circuit in both positions. Unfortunately, complicating such a configuration, a retractable antenna by its very nature has dynamic components, i.e., components which move or translate with respect to the housing and the printed circuit board, and as such does not generally have a single impedance value. Instead, the retractable antenna, if electrically contiguous, can generate largely different impedance values when in an extended versus a retracted position.

In the past, the antenna was configured to electrically separate two quarter wave components, one electrically connected in the retracted position and one electrically connected in the extended position. For example, as shown in FIG. 1, the antenna 10 includes a quarter wave helix 12 in the tip and a main rod or whip 14 sized to provide a quarter wave length resonance. The two electrical components were isolated by positioning a non-conductive plastic component 16 between the helix 12 and the rod 14. Unfortunately, the durability of this type of antenna can be problematic because the structure is easily broken during mechanical stress. As shown in the enlarged view of FIG. 1A, the antenna is prone to breakage at the non-conductive joint 18 between the whip and helix 12, 14. Also unfortunately, designs which enlarge the structure in an attempt to make the area more rigid, can make the antenna aesthetically undesirable to consumers. Further, designs which attempt to strengthen the configuration must generally do so in a way which provides the quarter wave resonance in both the extended and retracted position, a task that can involve additional circuit complexities.

OBJECTS AND SUMMARY OF THE INVENTION

It is therefore a first object of the present invention to provide a quarter wave-quarter wave antenna with improved durability and an aesthetically pleasing appearance which has good broadband match in both the retracted and extended positions.

It is yet another object of the present invention to provide an economical retractable quarter wave-quarter wave antenna assembly with improved mechanical strength and broadband operating frequencies.

These and other objects are satisfied by the present invention by a retractable antenna which employs a capacitively coupled rod element and helix, an electrically shorter rod element length, and additional metallic material in the junction between the helix and the rod. In particular, a first aspect of the invention is a quarter wave-quarter wave retractable antenna which comprises a quarter wave helix and a cylindrical antenna rod longitudinally spaced apart from the helix. The rod has a conductive core and an outer surface. The rod includes opposing first and second ends which define a central axis through the center thereof The second end has a lower contact in electrical communication with the core positioned on the outer surface of the antenna rod. The lower contact engages with a signal feed, e.g. a 50 Ω feed, operably associated with the printed circuit board when the antenna is extended.

The antenna also includes a conductive cylindrical component having top and bottom ends and inner and outer surfaces. The top end is connected to the helix and the bottom end is configured to receive portions of the first end of the antenna rod therein. A layer of non-conductive material is disposed intermediate of the cylindrical component inner surface and the rod such that the first end of the antenna rod is concentrically aligned with the cylindrical component and mechanically secured thereto. The conductive cylindrical component provides additional structural rigidity and support and acts to electrically couple the rod and the helix. The upper part of the cylindrical component electrically engages with the signal feed when the antenna is retracted.

Advantageously, the antenna is configured such that, when retracted, the rod's resonant frequency is well above the operating band of interest. Further, the rod element is sized to compensate for electric coupling such that, when extended, the helix acts as a higher impedance inductive element in series with the capacitive coupling, and the antenna is again a quarter wave resonator. Preferably, the antenna rod has an electrical length of less than 0.25 λ, and more preferably an electrical length of about 0.2 λ. Further preferably, the antenna rod is operable between about 800–950 MHz.

Another aspect of the present invention is a radiotelephone with a quarter-wave quarter-wave retractable antenna. The radiotelephone comprises a radiotelephone housing having an opening therein. A printed circuit board is disposed in the housing along with a signal feed that is in electrical communication with the printed circuit board. The radiotelephone also includes a longitudinally extending antenna adapted to be received in the housing opening such that the antenna is free to retract and extend relative thereto. The antenna comprises a top load element structurally configured to provide a quarter-wave electrical length and a spatially separated rod portion having an electrical length of less than a quarter-wave. The top load element and the rod are electrically joined together by a structurally defined capacitive coupling. The antenna also includes upper and lower electrical contacts such that when the antenna is retracted the upper contact electrically communicates with the signal feed to define a first signal path and when the antenna is extended the lower contact electrically communicates with the signal feed to define a second signal path.

Preferably, the capacitive coupling is defined by an outer cylindrical conductor and a portion of the rod. In a preferred embodiment, the rod extends into the outer cylindrical conductor a predetermined distance and is concentrically aligned with the outer cylindrical conductor. Also preferably, the outer cylindrical conductor and the rod are spaced apart but mechanically joined by an insulating material positioned therebetween.

Advantageously, the instant invention provides an improved retractable quarter wave quarter wave antenna with improved mechanical durability and good electrical characteristics. The foregoing and other objects and aspects of the present invention are explained in detail in the specification set forth below.

DESCRIPTION OF PREFERRED EMBODIMENTS

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout. Layers or dimensions may be exaggerated for clarity.

Figure 1:
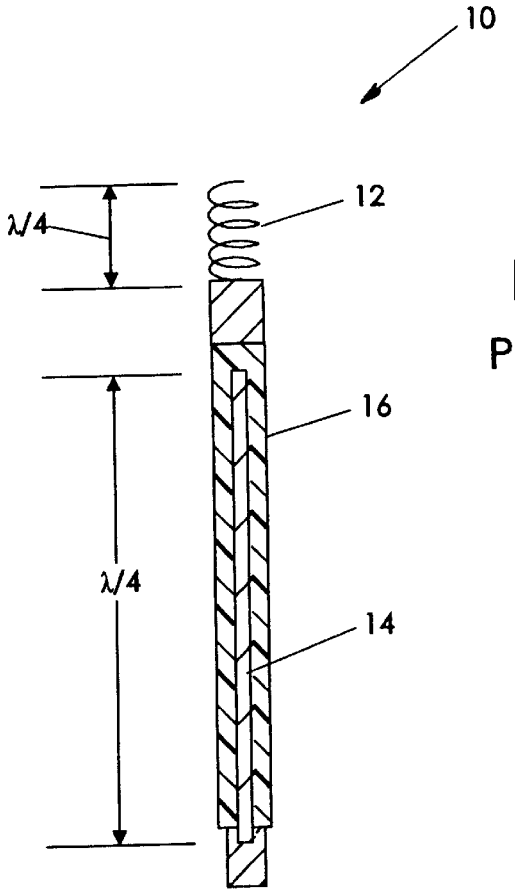
FIG. 1 PRIOR ART
FIG. 1 is a schematic representation of a prior art quarter-wave quarterwave retractable antenna.
Figure 1A:
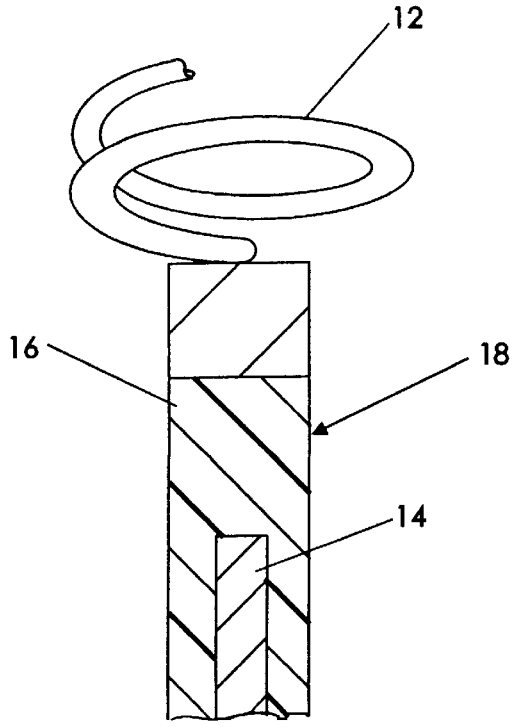
FIG. 1A PRIOR ART
FIG. 1A is an enlarged view of the antenna shown in FIG. 1.
Figure 2:
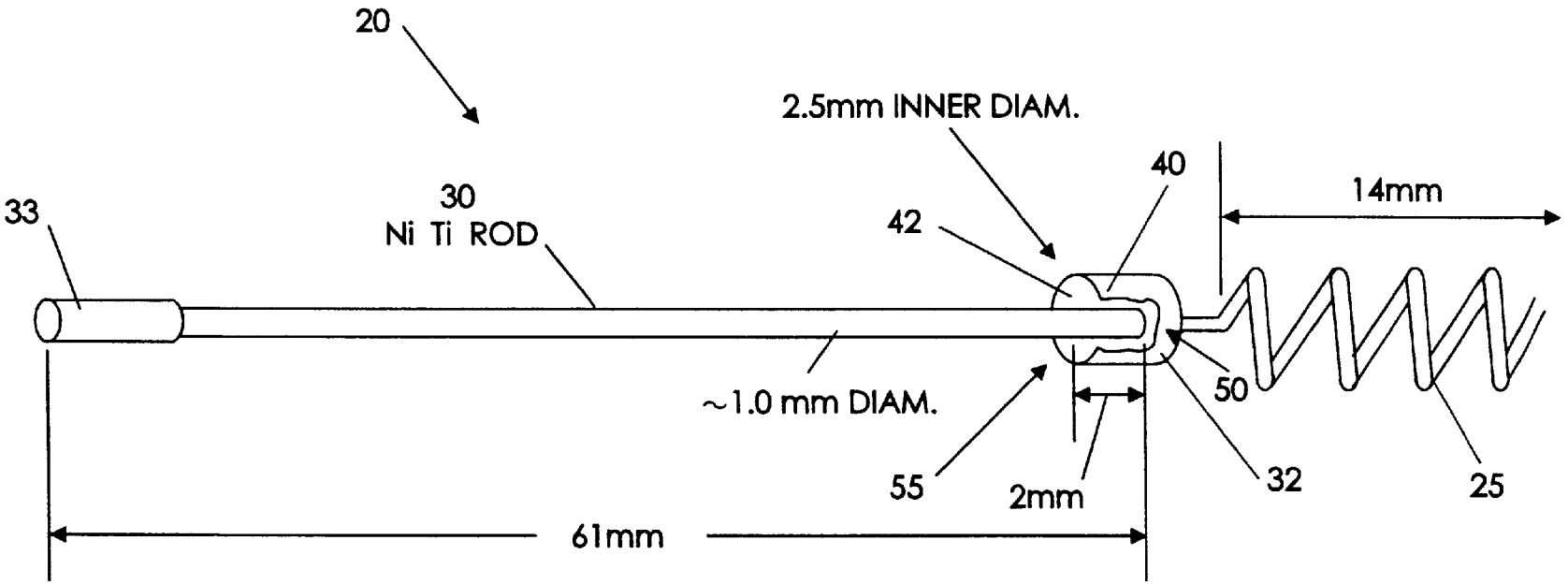
FIG. 2 is an enlarged partial cutaway view of a preferred embodiment of a quarter-wave quarter-wave retractable antenna according to the present invention.

Turning now to the drawings, FIG. 2 illustrates a preferred embodiment of a quarter-wave quarter-wave retractable antenna 20 according to the present invention. As is well known to those skilled in the art, an antenna forms part of a receiver circuit which has a band-limited frequency response; that is, which preferentially absorbs radio frequency energy within an operating band of frequencies, e.g., 800 MHz to 950 MHz. The receiver circuit may be viewed as having a peak resonant frequency somewhere within its band of operation, e.g., between 850 and 900 MHz, which corresponds to a wavelength k. As is well known to those skilled in the art, this wavelength may be used as a measure of effective length of an antenna. As referred to herein, "quarter wave" antennas include antennas having an effective length that is approximately $\lambda/4$, wherein $\lambda$ is as described above.

Advantageously, the structural configuration of the antenna provides mechanical rigidity to the antenna while also meeting the desired electrical characteristics. As shown, the antenna 20 includes a top loaded element such as a helix 25, a longitudinally extending rod or whip element 30, and upper and lower conductive contacts 32, 33. The antenna 20 also includes a cylindrical conductor 40 positioned adjacent the helix 25. The cylindrical conductor 40 joins the rod 30 to the helix 25 to provide mechanical strength and durability to the quarter-wave quarter-wave antenna 20. Although shown throughout as a top load helix, alternative antenna configurations can also be employed in the instant invention. For example, a top load antenna element such as a coil, disc or other type antenna load element.

Figure 7A:
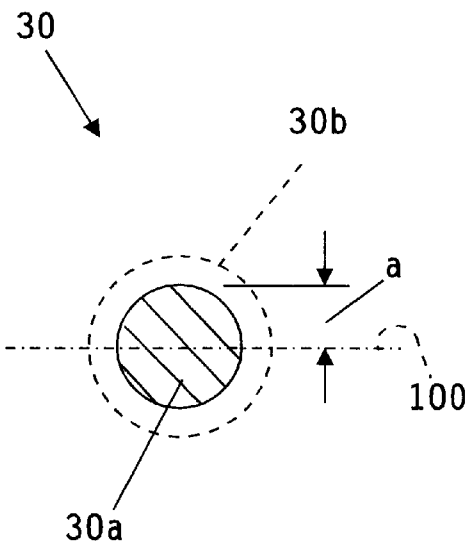
FIG. 7A is a sectional view of the antenna shown in FIG. 7 illustrating the radius of the core (a) of the antenna rod.
Figure 7:
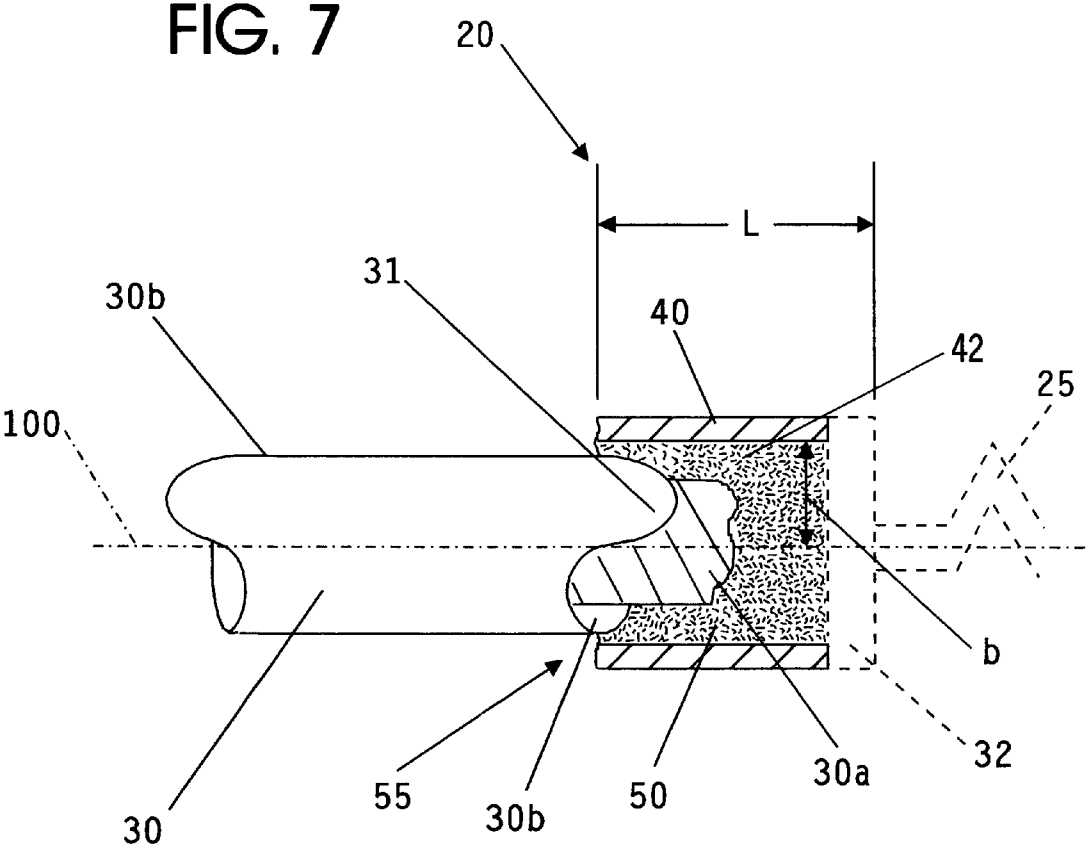
FIG. 7 is a diagram of the spatial relationship between the configuration of the antenna rod and the cylindrical conductor and corresponding equation parameters (L, b, a) used for capacitive calculations according to one embodiment of the present invention.

FIG. 7 is an enlarged cutaway view of one embodiment of the upper portion 31 of the antenna 20. As shown, the rod 30 is spatially separated from the upper contact 32 and helix 25, preferably by an insulating material layer 50. The rod 30 itself is preferably formed from a conductive core 30*a* covered by an insulating outer surface 30*b*. More preferably, the rod core 30*a* is flexibly formed from nickel titanium or the like. The cylindrical conductor 40 overlays the spatial separation of the rod 30 and the helix 25. The upper portion of the rod 31 extends a predetermined distance into an aperture 42 defined by the cylindrical conductor 40. Preferably, the rod 30 is positioned in the conductor 40 so that each is concentrically aligned with respect to the other about the central axis 100. As shown in FIG. 7, an insulating adhesive material 50 preferably holds the components in proper alignment and mechanically secures the rod 30 to the conductor 40. The structural coupling of the cylindrical conductor 40 and the upper portion of the rod 31 define a coaxial capacitor 55. Thus, unlike conventional quarter wave-quarter wave antennas, the mechanically strengthened antenna structure of the present invention is configured to electrically couple the rod 30 and the helix 25 when the antenna is retracted, as will be discussed further below.

Figure 3:
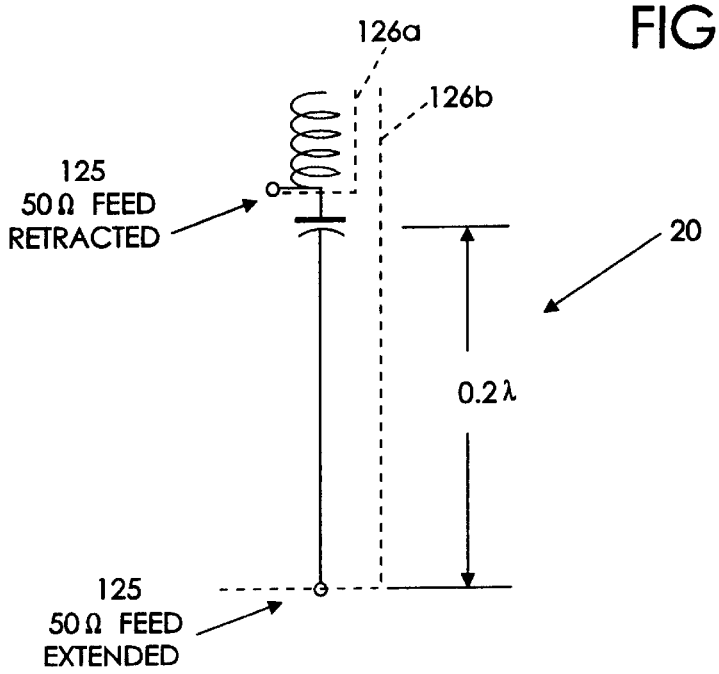
FIG. 3 is a schematic view of a retractable antenna according to the present invention.
Figure 5:
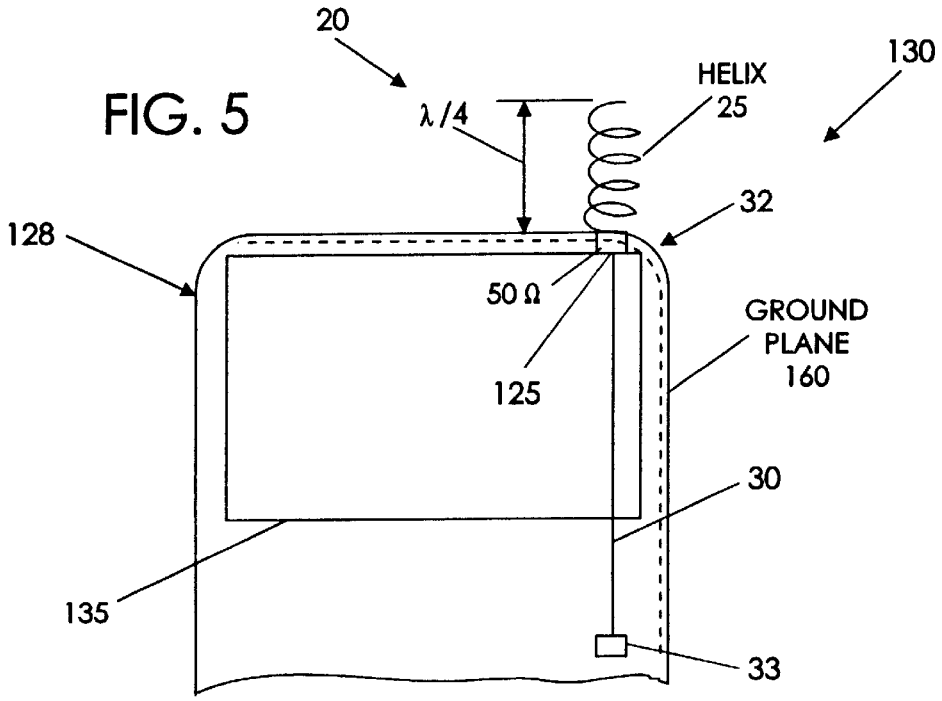
FIG. 5 is a schematic view of a radiotelephone with an antenna in the retracted position according to the present invention.
Figure 6:
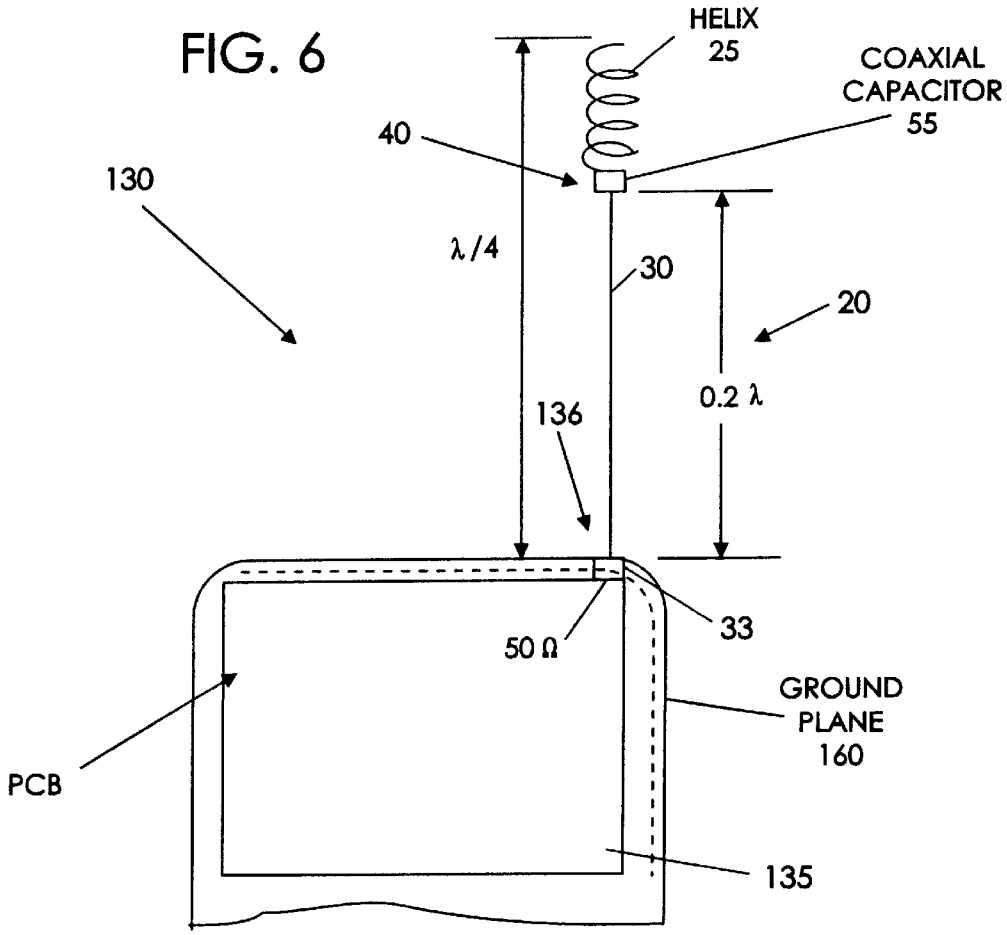
FIG. 6 is a schematic view of a radiotelephone with an antenna in the extended position according to the present invention.

FIGS. 5 and 6 illustrate the antenna 20 assembled to a radiotelephone housing 128. As shown in FIG. 3, the radiotelephone 130 includes a signal feed point 125 configured, for example, to provide a 50 Ohm impedance in both the extended and retracted positions. As will be appreciated by one of skill in the art, this signal feed 125 is electrically connected with the printed circuit board 135 or other substrate assembly which processes the radiotelephone signal (FIGS. 5, 6).

As shown in FIGS. 5 and 6, the radiotelephone 130 provides a ground plane 160, typically defined by the perimeter of the housing body 128, which generally includes a ground shield therearound. Again referring to FIGS. 5 and 6, it will be appreciated that when the antenna 20 is extended, a major portion of the antenna 20 is outside of the housing 128; in contrast, when the antenna 20 is retracted, a major portion of the antenna 20 is positioned inside the radiotelephone housing 128. In operation, the antenna 20 extends in and out of the housing passage 136 along the central axis 100 and engages with the housing 128 such that different circuit paths are defined and activated by the position of the antenna 20 corresponding to the retraction and extension of the antenna as will be discussed in more detail herein. The radiotelephone also includes a radiotelephone printed circuit board 135 disposed in the housing 128 adjacent the antenna 20 to connect the signal feed 125 from the antenna into and out of the radiotelephone.

As shown in FIG. 2, the upper contact 32 and the conductor 40 are preferably formed as an integral component. However, as will be appreciated by those of skill in the art, alternate configurations are also suitable. As shown in FIG. 5, the upper contact 32 engages with the signal feed 125 when the antenna 20 is retracted into the radiotelephone housing 128. Thus, in whatever configuration employed, the upper contact 32 should be configured to access and contact the signal feed 125 when the antenna 20 is retracted. Similarly, the lower contact 33 is preferably formed over the outer surface of the rod 30 and is in electrical communication with the core 30*a*. As illustrated in FIG. 6, the lower contact 33 is positioned to engage with the signal feed 125 when the antenna 20 is extended out of the housing 128.

Operationally, the upper contact 32 and the helix 25 are in electrical communication and the lower contact 33 is in electrical communication with the rod element 30. The top load element or helix 25 is configured to provide a quarter wave ($\lambda/4$) electrical length. Typically this parameter can be achieved by a multiple turn helix, for example, a seven turn helix configuration. Thus, as illustrated by FIG. 3, when retracted, the signal path 126*a* includes the helix 25 and the upper contact 32 which engages the signal feed 125. In the retracted position, the antenna rod element 30 forms a high Q series resonant circuit that has a resonant peak that is well above the operating band of interest.

In contrast to conventional quarter-wave quarter-wave models, the rod length is shortened to below 0.25 $\lambda$, and preferably shortened to about a 0.2 $\lambda$ wavelength. In the extended position, as illustrated in FIG. 3, the signal path 126*b* includes the helix 25, the series coaxial capacitor 55, the rod 30, and the lower contact 33 which engages the signal feed 125. As shown in FIG. 6, this signal path configuration provides an approximate $\lambda/4$ wavelength electrical response. Conventional wisdom might teach that a quarter wave top load element (i,e., an element positioned at the end of the main antenna rod) coupled through a series capacitor would detune the antenna. However, the instant invention recognizes and substantiates that the quarter wave helix configured according to the present invention does not behave as an additional quarter wave element in the extended position. Indeed, as a theoretical explanation which in no way limits the scope of the present invention, it is believed that since the quarter wave helix has no ground plane to work against in the extended position, it merely acts as a higher impedance inductive element. Thus, with a relatively small coaxial capacitor 55 in series, the affect is to add length to the quarter wave rod element 30. Therefore, the present invention reduces the length of the rod element 20 below $\lambda/4$ to compensate accordingly. Preferably, as noted above, the antenna rod element 30 is reduced to approximately 0.2 $\lambda$. Advantageously, the shortened rod (i.e., less than $\lambda/4$) has a very high resonance such that the resonant frequency of the rod is much greater than the band of interest and does not affect the tuning of the radiotelephone.

Figure 4:
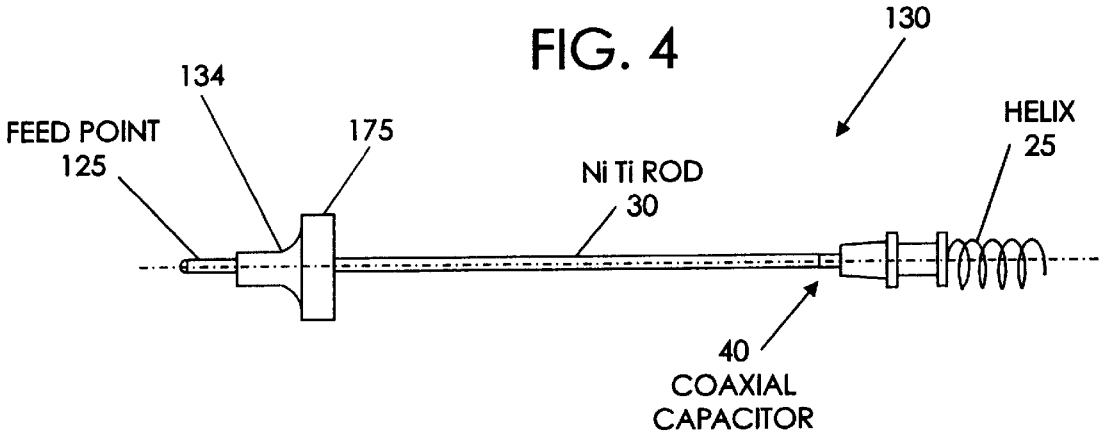
FIG. 4 is a side perspective view of one embodiment of an antenna according to the present invention.

As shown in FIGS. 5 and 6, the housing 128 includes an opening 129 formed through the center thereof. The opening 35 is sized and configured to allow the antenna 20 to translate (extend and retract) along the central axis 50 (the axis 100 defined by a line extending between the opposing ends of the antenna 30 as shown in FIG. 7A. In one embodiment a radiotelephone 130 can include a ground insert with a threaded portion for easy antenna attachment as is used on many current radiotelephones (not shown). The radiotelephone 130 in FIG. 4 represents a reduction to practice of one embodiment of the instant invention. The antenna translates in and out of a member 175 having threads 134 which can be easily assembled to corresponding housing threaded portions.

FIGS. 7 and 7A illustrate geometrical and electrical relationships which can be used to determine a configuration of the support or cylindrical contact 40 and antenna rod 30 to assist in obtaining desired structural lengths and corresponding electrical performance. For example, a preferred capacitance value is about three (3) picofarads (pf) for an 800 Mhz band radiotelephone. Preferably, varying the geometric parameters listed in Equation 1, a selected length of the support body 40 and the corresponding capacitance can be determined according to:

$$C=2\pi\epsilon L/(1n(b/a)). \qquad \text{Equation 1}$$

In this equation, "$\epsilon$" is the dielectric constant of the material used over the antenna core (for example, a DELRINυ extrusion over a NiTi rod); "L" is the longitudinal length of the contact ferrule 40; "a" is the radius of the antenna core 30*a*; and "b" is the inner radius of the contact ferrule 40. Preferably, the outer surface of the rod 30*b* is concentric with the core 30*a*. Typically, the outer surface material is extruded or bonded and fused to the core 30*a*. Using DELRIN™, an exemplary ferrule length is about 11.5 mm. As will be understood by one of skill in the art, for a specified capacitance value, the length of the ferrule (L) needed is affected by the strength of the dielectric constant of the outer surface material of the antenna rod. Nylon and similar materials typically have relative dielectric constants about 3.7 with TEFLON™ at about 2.1.

In order to achieve the desired operating characteristics for the antenna in the extended position, one can size the cylindrical conductor to achieve the desired mechanical strength and then trim the rod to resonate at a preferred frequency, e.g., about 800–950 MHz. FIG. 2 shows one embodiment of the present invention. This embodiment illustrates exemplary dimensions of the structural joint between the rod 30 and cylindrical conductor 40. The rod 30 has a one millimeter ("mm") outer diameter and is extended into the cylindrical conductor about 2 millimeters. The cylindrical conductor 40 has an inner diameter of about 2.5 mm. Thus, the insulating layer extends around the two components and is approximately 0.75 mm thick. In this example, the rod is approximately 61 mm in length and the antenna helix length is approximately 14 mm (from the first turn to the last turn).

Figure 8:
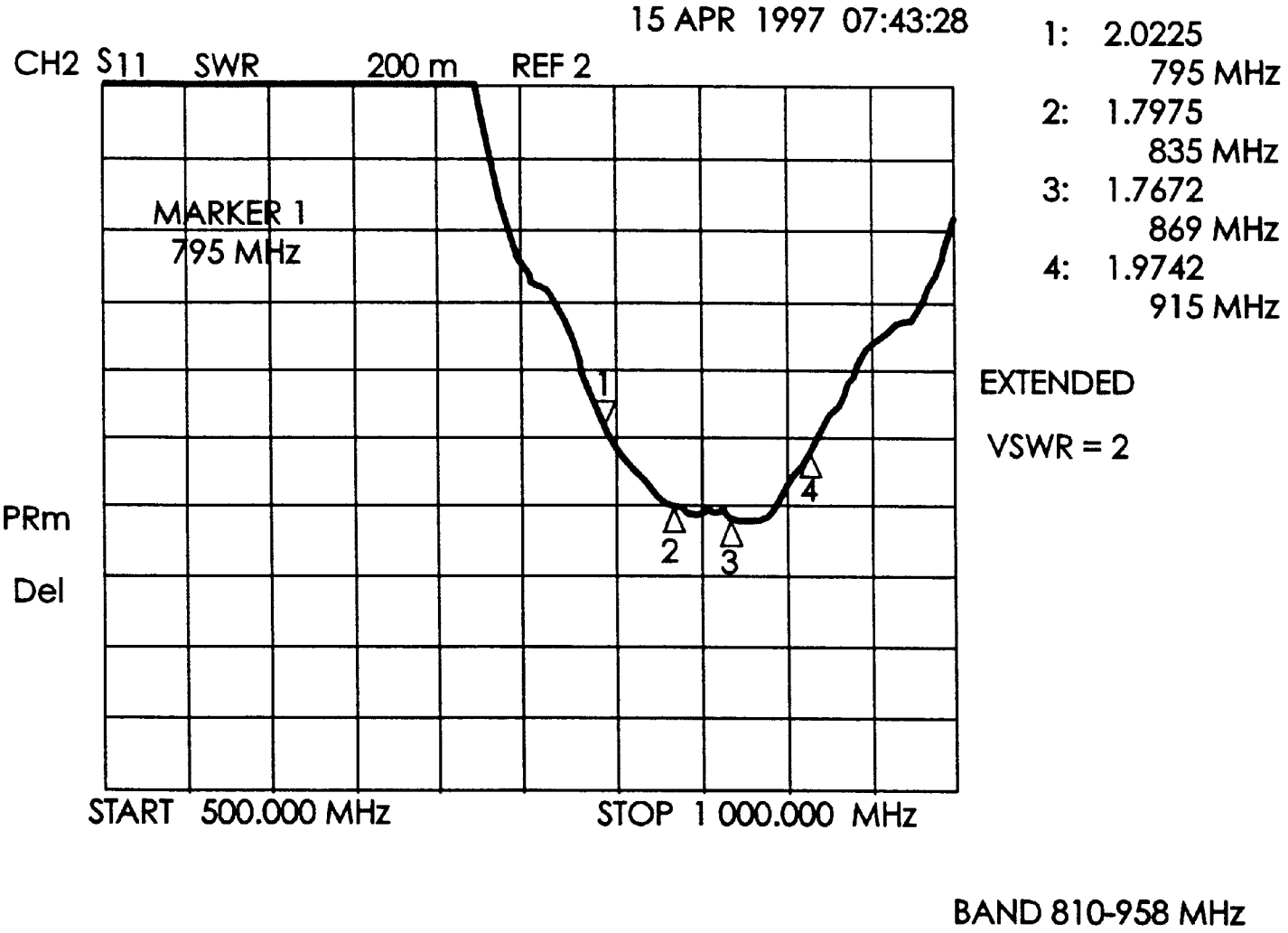
FIG. 8 is a graphical representation of test data graphed on a Voltage Standing-Wave Ratio ("VSWR") plot (in the 810–958 MHz band) illustrating an antenna in the extended position according to the present invention.
Figure 9:
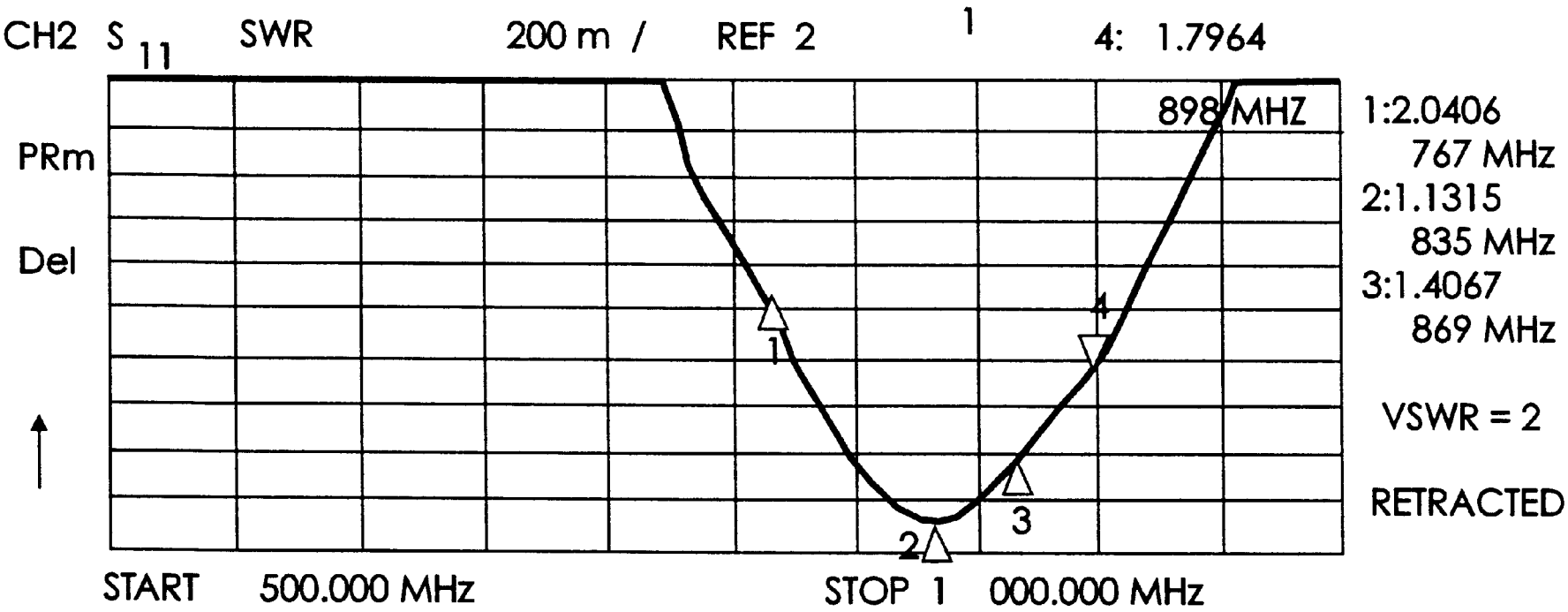
FIG. 9 is a graphical representation of test data graphed on a VSWR plot illustrating an antenna in the retracted position according to the present invention.

FIGS. 8 and 9 illustrate data taken from a reduction to practice of one embodiment of the present invention (shown in FIG. 4). In particular, VSWR measuremens for retracted (FIG. 8) and extended (FIG. 9) positions. As shown in the graphs of FIGS. 8 and 9, the VSWR measurements indicate that the impedance between the retracted and extended positions is substantially the same, evidencing the success of the configuration of a quarter-wave, quarter-wave retractable antenna provided by the instant invention.

As will be appreciated by those of skill in the art, additional discrete circuit components corresponding to the impedance requirements of the antenna can be employed with the antenna and can be mounted separately or integrated into a printed circuit board. Similarly, the term "printed circuit board" is meant to include any microelectronics packaging substrate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A quarter-wave retractable antenna, comprising:

a quarter wave helix;

a cylindrical antenna rod longitudinally spaced apart from said helix, said antenna rod having a conductive core with a radial width, and an outer surface and including opposing first and second ends defining a central axis through the center thereof, said second end having a lower contact in electrical communication with said core and positioned on the outer surface of said antenna rod; and a conductive cylindrical component having top and bottom ends and inner and outer surfaces, said top end connected to said helix and said bottom end configured with a cylindrical opening to receive a portion of the first end of said antenna rod therein, wherein a layer of non-conductive material is disposed intermediate of said component inner surface and said rod such that the first end of said antenna rod is spaced apart from and concentrically aligned with said cylindrical component and mechanically secured theretogether to define a capacitive coupling therebetween, wherein said retractable antenna is configured to linearly extend and retract about the central axis, said antenna having an operable extended position and an associated extended signal path, and wherein said helix, said capacitive coupling, and said antenna rod are included in the extended signal path to together define about a quarter wave length impedance.

2. An antenna according to claim 1, wherein said cylindrical component is radially spaced apart from said antenna rod, and wherein said antenna rod is fixed within said cylindrical component such that it is longitudinally spaced apart from said cylindrical component first end to define a coaxial capacitive electrical coupling therebetween.

3. An antenna according to claim 1, wherein said first end of said antenna rod extends into said cylindrical component a distance of about 3 mm.

4. An antenna according to claim 1, wherein said antenna rod has an electrical length less than 0.25λ in isolation of said helix and said capacitive coupling at the frequency of operation.

5. An antenna according to claim 4, wherein said antenna rod has an electrical length of about 0.2λ in isolation of said helix and said capacitive coupling at the frequency of operation.

6. An antenna according to claim 1, wherein said antenna is operable between about 800–950 MHz.

7. An antenna according to claim 2, wherein the capacitance value of said capacitor corresponds to the radial width of said antenna rod core, and the length and radial width of the inner surface of said cylindrical contact with respect to the central axis.

8. An antenna assembly according to claim 1, wherein said capacitive coupling is a coaxial capacitive coupling, and wherein the capacitance (C) of said capacitive coupling is calculated by the equation, $$C=2\pi\epsilon L/(1n(b/a))$$

wherein "L" is the longitudinal length of said conductive component, "b" is the radial width of said cylindrical opening of said conductive component, "a" is the radial width of said conductive core of said antenna, and "ϵ" is the dielectric constant of a non-conductive outer material layer of said antenna rod.

9. A radiotelephone with a quarter-wave quarter-wave retractable antenna, comprising:

a radiotelephone housing having an opening therein;

a printed circuit board disposed in said housing;

a signal feed disposed in said housing such that it is in electrical communication with said printed circuit board; and a longitudinally extending antenna adapted to be received in said housing opening such that said antenna is free to retract and extend relative thereto between an extended position and a retracted position, said antenna comprising:

a top load element structurally configured to provide about a quarter-wave electrical length at the frequency of operation;

a linear rod having an electrical length of less than about a quarter-wave at the frequency of operation, said linear rod having opposing top and bottom portions, said rod top portion being longitudinally spaced apart from said top load element;

a cylindrical component, said cylindrical component having opposing top and bottom ends, said top end connected to said top load element and said bottom end having an opening formed therein, wherein said antenna rod top portion enters a distance within said cylindrical component opening and terminates within said cylindrical component opening, a longitudinal distance below said cylindrical component top end, and wherein said antenna rod is radially spaced apart from said cylindrical component to define a capacitive coupling therebetween, and wherein said cylindrical component comprises an insulating adhesive material configured to substantially fill said opening and contact said antenna rod top portion such that said cylindrical component and said antenna rod are structurally joined together;

upper and lower electrical contacts, wherein when said antenna is in the retracted position said upper contact electrically communicates with said signal feed to define a first signal path, and when said antenna is in the extended position said lower contact electrically communicates with said signal feed to define a second signal path, and wherein said antenna exhibits about a λ/4 impedance in both said first and second signal paths at the frequency of operation.

10. A radiotelephone with a quarter-wave quarter-wave antenna according to claim 9, wherein said rod extends into said cylindrical component at a predetermined distance and is concentrically aligned with said cylindrical component such that said cylindrical component and said rod define a coaxial capacitive coupling therebetween.

11. A radiotelephone with a quarter-wave quarter-wave antenna according to claim 9, wherein said first signal path includes said quarter-wave top load element and said second signal path includes in series, said quarter-wave top load element, said capacitive coupling, and said rod.

12. A radiotelephone according to claim 11, wherein said top load element in said second signal path acts as an inductive element.

13. A radiotelephone according to claim 11, wherein said capacitive coupling is such that it provides about a 3 pf coaxial capacitor.

14. A radiotelephone according to claim 9, wherein said rod is a cylindrical linear antenna rod having a conductive core with a first radial width and an outer non-conductive layer with a second radial width, and wherein said cylindrical component has a longitudinally extending length and said cylindrical component opening is sized with a third radial width, and wherein the capacitance value of said capacitive coupling corresponds to said first radial width of said core, and said longitudinal length and said third radial width of said cylindrical component.

15. A radiotelephone according to claim 9, wherein said antenna rod has a conductive core with a radial width and a non-conductive outer material layer, and wherein said cylindrical component and said antenna rod are configured and sized to provide a desired coaxial capacitive coupling capacitance (C) according to the relationship represented by the equation, $$C=2\pi\epsilon L/(1n(b/a))$$

wherein "L" is the longitudinal length of said conductive component, "b" is the radial width of said cylindrical opening of said conductive component, "a" is the radial width of said conductive core of said antenna, and "$\epsilon$" is the dielectric constant of the non-conductive outer material layer of said antenna rod.

* * * * *

UNITED STATES PATENT AND TRADEMARK OFFICE

CERTIFICATE OF CORRECTION

PATENT NO. : 6,054,958
DATED : April 25, 2000
INVENTOR(S) : Holshouser et al.

It is certified that error appears in the above-identified patent and that said Letters Patent is hereby corrected as shown below:

Column 7,
Line 13, should read

-- • 1. A quarter-wave quarter-wave retractable antenna, comprising:

Column 8,
Line 35, should read

-- • within said cylindrical component opening a longi- --

Signed and Sealed this

Fifth Day of November, 2002

*Attest:*

*Attesting Officer*

JAMES E. ROGAN
*Director of the United States Patent and Trademark Office*